US009799997B2

(12) United States Patent
Scanzillo et al.

(10) Patent No.: US 9,799,997 B2
(45) Date of Patent: Oct. 24, 2017

(54) PUSH WIRE CONNECTOR HAVING A ROTATABLE RELEASE MEMBER

(71) Applicant: Hubbell Incorporated, Shelton, CT (US)

(72) Inventors: Thomas L. Scanzillo, Monroe, CT (US); Edward R Bazayev, Kew Gardens, NY (US); Robert Simon, Shelton, CT (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/876,281

(22) Filed: Oct. 6, 2015

(65) Prior Publication Data

US 2016/0036180 A1 Feb. 4, 2016

Related U.S. Application Data

(62) Division of application No. 14/015,404, filed on Aug. 30, 2013, now Pat. No. 9,246,242.

(60) Provisional application No. 61/697,106, filed on Sep. 5, 2012.

(51) Int. Cl.

| | |
|---|---|
| ***H01R 13/15*** | (2006.01) |
| ***H01R 24/30*** | (2011.01) |
| ***H01R 4/50*** | (2006.01) |
| ***H01R 4/48*** | (2006.01) |
| ***H01R 24/20*** | (2011.01) |
| ***H01R 24/76*** | (2011.01) |
| *H01R 24/22* | (2011.01) |
| *H01R 105/00* | (2006.01) |

(52) U.S. Cl.

CPC ..... *H01R 24/30* (2013.01); *H01R 4/48* (2013.01); *H01R 4/4818* (2013.01); *H01R 4/4836* (2013.01); *H01R 4/5008* (2013.01); *H01R 24/20* (2013.01); *H01R 24/76* (2013.01); *H01R 24/22* (2013.01); *H01R 2105/00* (2013.01)

(58) Field of Classification Search

CPC ..... H01R 4/20; H01R 4/50; H01R 25/006; H01R 4/4845; H01R 24/30

USPC ..... 439/259, 535, 828, 76, 76.1

See application file for complete search history.

(56) References Cited

U.S. PATENT DOCUMENTS

| | | | |
|---|---|---|---|
| 2,466,930 | A | 4/1949 | Cook |
| 2,720,634 | A | 10/1955 | Hart |
| 3,093,433 | A | 6/1963 | Ege |
| 3,945,711 | A | 3/1976 | Hohorst |
| 3,963,305 | A | 6/1976 | Doktor |

(Continued)

*Primary Examiner* — Abdullah Riyami
*Assistant Examiner* — Nader Alhawamdeh
(74) *Attorney, Agent, or Firm* — Dickinson Wright PLLC

(57) ABSTRACT

An electrical connector includes a housing and a conductive contact member disposed in the housing. A first contact portion of the conductive contact member receives a blade contact of an electrical device and a second contact portion electrically engages an inserted electrical wire. A spring member is disposed in the housing and is connected to the contact member. A rotatable member is movable between first and second positions. When the rotatable member is in the second position the spring member secures an inserted wire in electrical engagement with the conductive contact member and prevents removal of the inserted wire. When the rotatable member is in the first position the spring member allows for removal of an inserted wire and allows for insertion of a wire in the housing.

5 Claims, 18 Drawing Sheets

(56) References Cited

U.S. PATENT DOCUMENTS 3,999,829 A * 12/1976 Glaesel ..... H01R 4/40 439/437
4,563,054 A 1/1986 Wilmes
5,454,730 A 10/1995 Tozuka
5,494,456 A 2/1996 Kozel
5,679,021 A 10/1997 Kramer
5,735,700 A 4/1998 Hohorst
5,816,867 A 10/1998 Davidsz
5,975,940 A 11/1999 Hartmann
6,132,238 A 10/2000 Hartmann
6,146,187 A 11/2000 Pallai
6,146,217 A 11/2000 Osada
6,155,890 A 12/2000 Gerberding
6,350,162 B1 * 2/2002 Despang ..... H01R 4/4845 439/828
6,464,545 B2 10/2002 Yano
6,634,898 B2 10/2003 Clements
6,682,364 B2 1/2004 Cisey
6,719,581 B2 4/2004 Kikuchi
6,746,286 B2 6/2004 Blaha
6,750,402 B2 * 6/2004 Geske ..... H01R 4/4845 174/135
6,773,313 B2 * 8/2004 Pedrinelli ..... H01R 4/4845 439/828
6,814,608 B2 11/2004 Kollmann
6,832,938 B2 12/2004 Lenker
6,911,602 B2 6/2005 Conrad
6,981,890 B2 1/2006 Cutler
7,083,463 B2 8/2006 Steinkemper
7,115,001 B1 10/2006 Brockman
7,131,857 B2 11/2006 Mueller
7,140,887 B2 11/2006 Poh
7,150,646 B2 * 12/2006 Trumper ..... H01R 4/4818 439/441
7,179,137 B1 2/2007 Quendt et al.
7,195,517 B1 * 3/2007 Savicki, Jr. ..... H01R 23/10 174/58
7,238,043 B2 7/2007 Reibke
7,241,188 B2 7/2007 Lin
7,249,963 B2 7/2007 Ramm
7,281,942 B2 10/2007 Swedberg
7,384,319 B2 6/2008 Kirstein
7,402,075 B1 7/2008 Probst
7,438,587 B2 10/2008 Germani
7,510,429 B1 * 3/2009 Savicki, Jr. ..... H01R 25/003 174/53
7,527,509 B1 5/2009 Bethurum
7,628,640 B2 12/2009 Radle
7,645,158 B2 1/2010 Mulhouse
7,651,363 B2 1/2010 Koellmann
7,690,952 B2 4/2010 Koellmann
7,736,174 B2 * 6/2010 Bhosale ..... F21V 33/00 365/95
7,749,018 B1 7/2010 Benoit et al.
7,794,268 B2 9/2010 Breen, IV
7,815,463 B2 10/2010 Gerberding
7,833,038 B1 * 11/2010 King, Jr. ..... H01R 4/4818 439/276
7,845,970 B2 12/2010 Stromiedel
7,896,686 B2 3/2011 Hoppe
7,909,664 B2 * 3/2011 Ilkhanov ..... H01R 4/5008 439/107
7,963,812 B2 * 6/2011 Ilkhanov ..... H01R 4/5008 439/107
7,976,330 B2 7/2011 Lin
8,096,818 B2 1/2012 Arenas
8,105,094 B2 * 1/2012 Patel ..... H01Q 1/2233 439/535
8,137,115 B1 * 3/2012 Chou ..... H01R 9/24 136/244
8,235,748 B2 8/2012 Lacey
8,466,367 B2 6/2013 Reibke
8,684,771 B2 * 4/2014 Bhosale ..... H01R 13/35 439/106
2003/0236010 A1 * 12/2003 Gorman ..... H01R 31/065 439/107
2005/0212646 A1 * 9/2005 Watchorn ..... H01H 37/5409 337/16
2006/0028316 A1 * 2/2006 Fabian ..... H01H 37/5409 337/36
2007/0211397 A1 * 9/2007 Sokolow ..... H01R 13/4534 361/42
2008/0268679 A1 * 10/2008 Tiberio ..... H01R 13/506 439/135
2010/0227484 A1 * 9/2010 Arenas ..... H01R 9/2491 439/107

* cited by examiner

PUSH WIRE CONNECTOR HAVING A ROTATABLE RELEASE MEMBER

CROSS REFERENCE TO RELATED APPLICATION

This application is a divisional of currently pending U.S. patent application Ser. No. 14/015,404, which is hereby incorporated by reference in its entirety, and which was filed on Aug. 30, 2013 and claims the benefit of U.S. Provisional Patent Application Ser. No. 61/697,106, filed on Sep. 5, 2012 of which is hereby incorporated by reference in its entirety. This application contains subject matter related to co-pending U.S. patent application Ser. No. 14/015,360 entitled "Push Wire Connector Having A Spring Biasing Member," filed Aug. 30, 2013, which is hereby incorporated by reference in its entirety.

FIELD OF THE INVENTION

The present invention relates generally to push wire connectors for terminating electrical wires. More particularly, the present invention relates generally to push wire connectors for terminating electrical wires having a rotatable release member to facilitate electrically and mechanically engaging and disengaging electrical wires. Still more particularly, the present invention relates to a push wire electrical connector having push wire connections for terminating a plurality of electrical wires and connectable to an electrical device to provide electrical continuity between the electrical wires and the electrical device.

BACKGROUND OF THE INVENTION

Some electrical devices have apertures in their rear faces for receiving a plug terminating a plurality of wires, as disclosed in U.S. Pat. No. 4,842,551 to Heimann. The wires terminated by the plug are connected to the existing building wires in any suitable manner, such as by a clamp receptacle or a twist-on wire connector. However, connecting each plug wire to a building wire with the twist-on wire connector, or similar device, requires time to make the connection. Additionally, a significant amount of wire needs to be inserted in the electrical box when connecting the electrical receptacle to an electrical box. The large amount of wire can be difficult to dispose in the electrical box with the electrical device. Accordingly, a need exists for a plug that snaps into an aperture in a rear surface of the electrical device and terminates existing building wires through a push wire connection.

SUMMARY OF THE INVENTION

An object of the present invention is to provide a push wire connector for securely, quickly and easily terminating electrical wires.

Another object of the present invention is to provide a push wire connector having a rotatable release member to facilitate electrically and mechanically engaging and releasing electrical wires.

Another object of the present invention is to provide an electrical connector for terminating a plurality of electrical wires and being connectable to an electrical device to provide electrical continuity between the electrical wires and the electrical device.

The foregoing objectives are basically attained by an electrical connector including a housing and a conductive contact member disposed in the housing. A first contact portion of the conductive contact member receives a blade contact of an electrical device and a second contact portion electrically engages an inserted electrical wire. A spring member is disposed in the housing and is connected to the contact member. A rotatable member is movable between first and second positions. When the rotatable member is in the second position the spring member secures an inserted wire in electrical engagement with the conductive contact member and prevents removal of the inserted wire. When the rotatable member is in the first position the spring member allows for removal of an inserted wire and allows for insertion of a wire in the housing.

The foregoing objectives are basically attained by an electrical connector including a housing and a conductive contact assembly disposed therein. A first contact portion of the conductive contact assembly receives a blade contact of an electrical device and a second contact portion electrically engages an inserted electrical wire. A locking member is movably disposed between first and second positions with respect to the second contact portion. A biasing member is disposed in the housing and is disposed between the second contact portion and the locking member. A release member is rotatable between first and second positions. The release member in the first position moves the locking member to the first position to compress the biasing member to allow for insertion and removal of the electrical wire. The release member is spaced from the locking member in the second position such that the biasing member moves the locking member to the second position to secure the inserted electrical wire between the locking member and the second contact portion and substantially prevents removal thereof The foregoing objectives are also basically attained by an electrical connector including a housing and a conductive contact assembly disposed therein. A contact portion of the conductive contact assembly electrically engages an inserted electrical wire. A biasing member is disposed in the housing and has a first resilient arm. A release member is movable between first and second positions. The release member in the first position allows for insertion of the electrical wire such that the inserted wire is secured between the first resilient arm and the contact portion and is prevented from being withdrawn therefrom. The release member in the second position deflects the first resilient arm such that the inserted wire is withdrawable from the electrical connector.

Objects, advantages, and salient features of the invention will become apparent from the following detailed description, which, taken in conjunction with the annexed drawings, discloses an exemplary embodiment of the present invention.

As used in this application, the terms "front," "rear," "upper," "lower," "upwardly," "downwardly," and other orientational descriptors are intended to facilitate the description of the exemplary embodiments of the present invention, and are not intended to limit the structure thereof to any particular position or orientation.

BRIEF DESCRIPTION OF THE DRAWINGS

The above benefits and other advantages of the various embodiments of the present invention will be more apparent from the following detailed description of exemplary embodiments of the present invention and from the accompanying drawing figures, in which.

Throughout the drawings, like reference numerals will be understood to refer to like parts, components and structures.

DETAILED DESCRIPTION OF EXEMPLARY EMBODIMENTS

The exemplary embodiments of the present invention are directed to an electrical connector that terminates electrical wires through a push wire connection, as shown in FIGS. 1-36.

Figure 1:
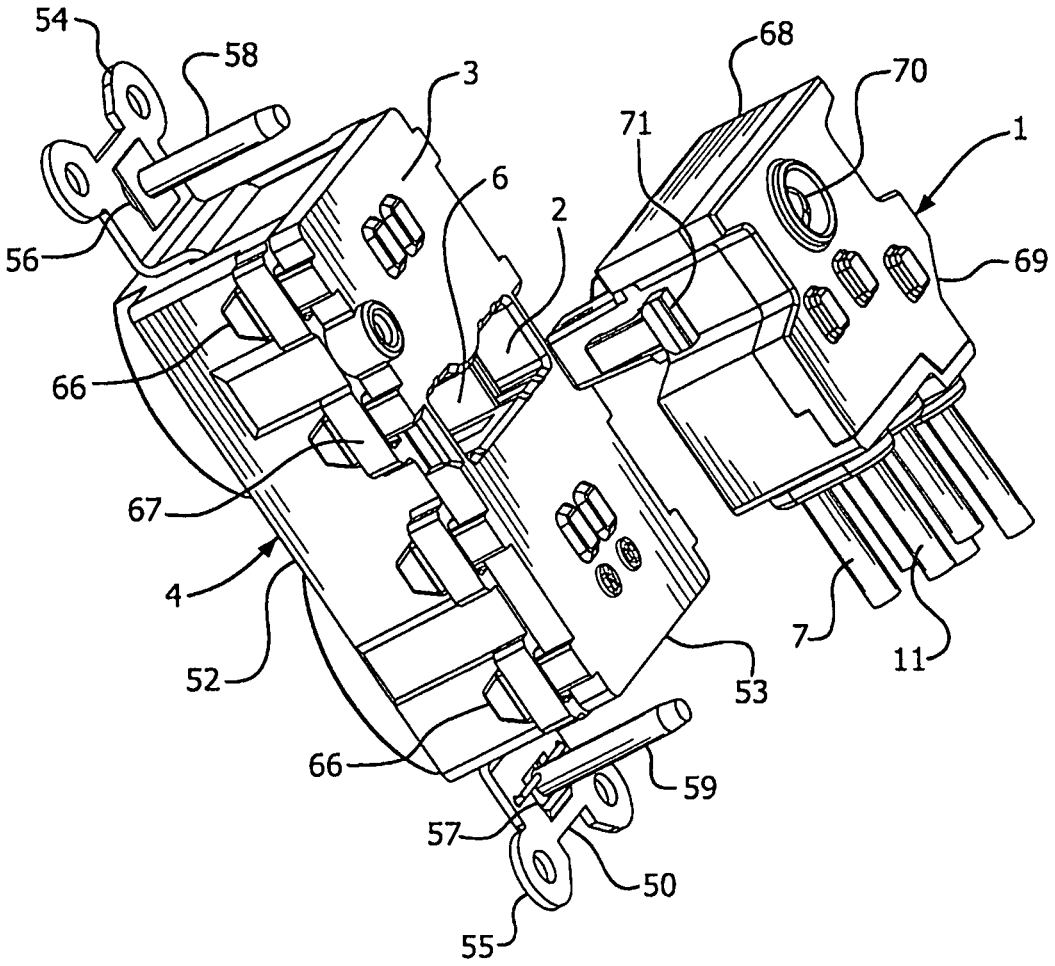
FIG. 1 is an exploded perspective view of an electrical wiring device with a push wire connector in accordance with a first exemplary embodiment of the present invention prior to connecting to the electrical wiring device.
Figure 2:
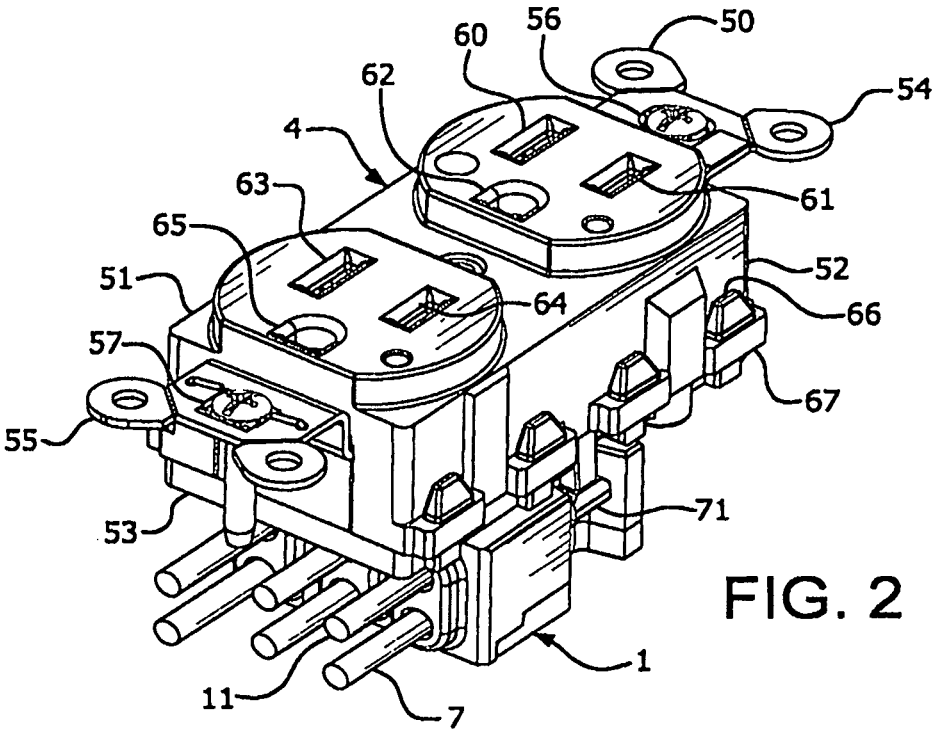
FIG. 2 is a front perspective view of the push wire connector of FIG. 1 connected to the electrical wiring device.
Figure 3:
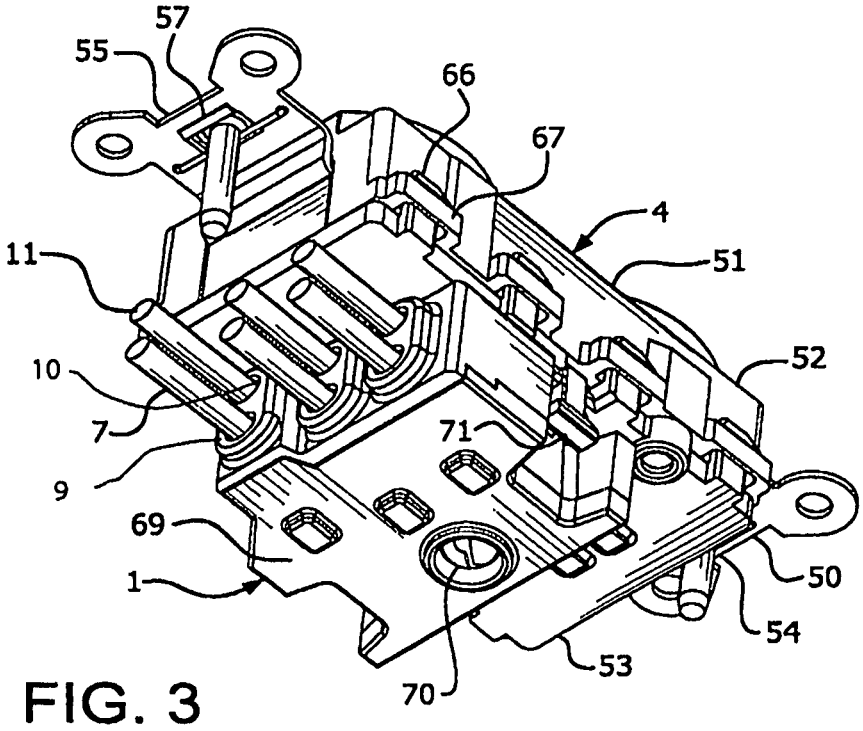
FIG. 3 is a rear perspective view of the push wire connector connected to the electrical wiring device of FIG. 2.

An electrical connector 1 in accordance with a first exemplary embodiment of the present invention does not require a tool for electrical wire termination, as shown in FIGS. 1-3. The electrical connector 1 is received in an aperture 2 in a rear surface 3 of an electrical device 4, such as an electrical receptacle. The electrical connector 1 has a plurality of contact assemblies 5 that engage blades 6 disposed in the aperture 2 of the electrical receptacle 4, thereby establishing electrical continuity between the building wires 7 and the electrical receptacle 4. Although the electrical connector in accordance with exemplary embodiments of the present invention is described with respect to the electrical receptacle 4, the present invention is not so limited and any suitable electrical device may be used.

Figure 4:
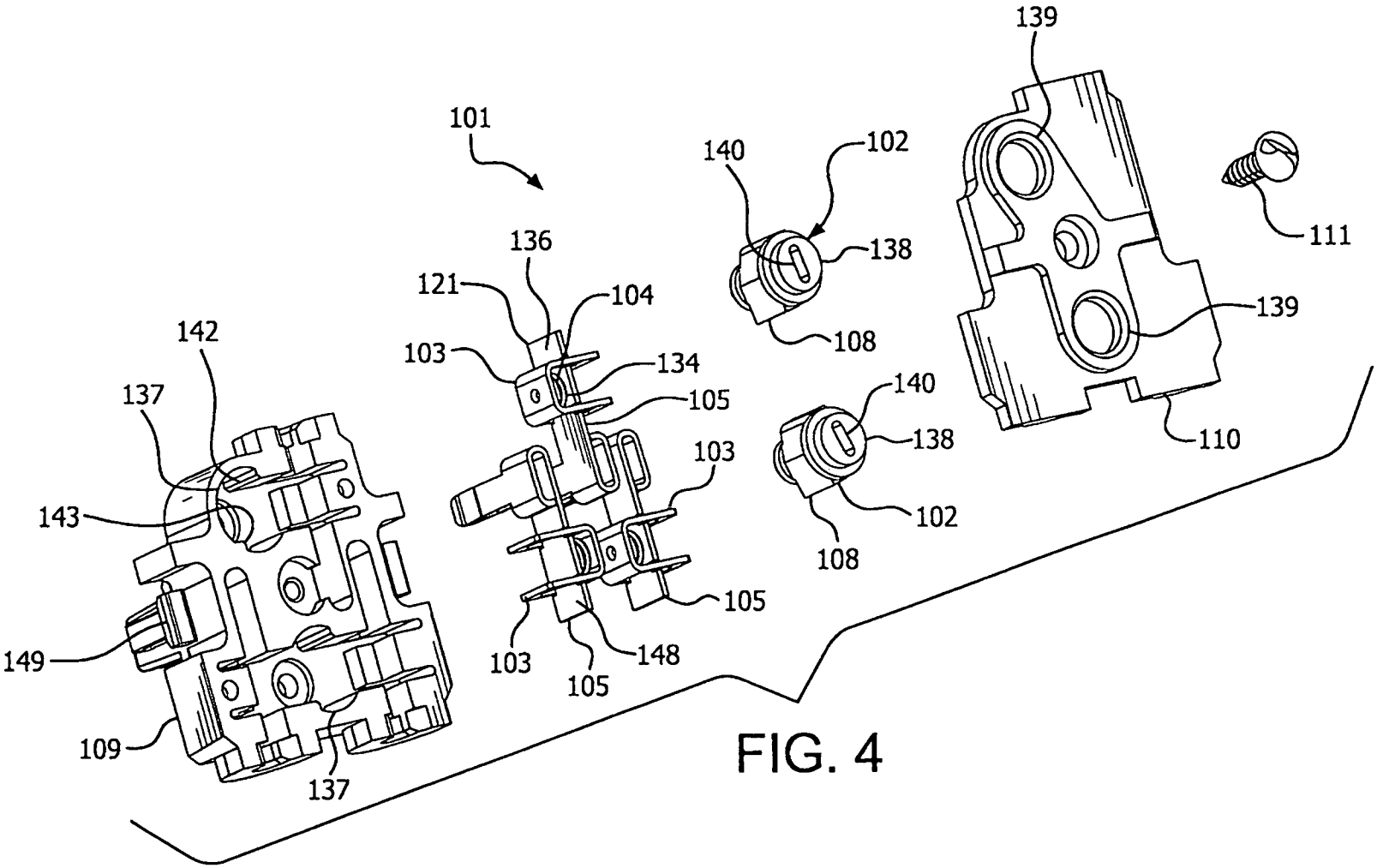
FIG. 4 is a front exploded perspective view of a push wire connector in accordance with a second exemplary embodiment of the present invention.

The electrical device 4 includes a housing 51 having the rear surface 3 and the aperture 2 disposed in the rear surface. A ground or mounting strap 50 is connected to the housing 51 and is adapted to secure the electrical device 4 to an electrical box (not shown). A plurality of contact blades 6 are disposed in the electrical device 4 and are accessible through the aperture 2 (FIG. 4). The electrical connector 1 includes a plurality of contact assemblies 5 adapted to engage the plurality of contact blades 6 in the electrical device 4, as shown in FIGS. 2 and 3. The wires 7 terminated by the electrical connector 1 extend outwardly therefrom such that the plurality of wires are substantially parallel to the rear surface 3 of the electrical device 4 when the electrical connector 1 is connected to the electrical device 4. The wires 7 are terminated by a push-wire connection such that the wires can be terminated without requiring the use of a tool. Alternatively, the wires 7 can be terminated such that the wires are substantially perpendicular to the rear surface 3 of the electrical receptacle 4.

The electrical device 4 includes a cover 52 connected to a base 53, as shown in FIGS. 1-3. The mounting strap 50 is connected to the electrical device 4 to facilitate mounting the electrical device to the electrical box (not shown). First and second mounting ears 54 and 55 are disposed at opposite ends of the ground strap 50. Each mounting ear 54 and 55 has an opening 56 and 57 to receive a fastener 58 and 59 to secure the electrical device 4 to the electrical box in a conventional manner. The ground strap 50 may be disposed between the cover 52 and the base 53, or may wrap around the rear surface 3 of the base 53.

A first plurality of openings 60, 61 and 62 are formed in the cover 52 to receive a first plug (not shown) of an electrical apparatus to be powered by the electrical device 4. A second plurality of openings 63, 64 and 65 are formed in the cover 52 to receive a second plug (not shown) of an electrical apparatus to be powered by the electrical device 4. The cover 52 has a plurality of downwardly extending posts 66 that are receivable by pockets 67 of the base 53, thereby creating a snap fit to secure the cover 52 to the base 53 as shown in FIGS. 1-3.

The aperture 2 disposed in the rear surface 3 of the base 53, as shown in FIG. 1, is adapted to receive the electrical connector 1 that terminates building wires 7 that supply electrical power. Preferably, three contact blades 6 are disposed in the aperture 2, although any suitable number of contact blades may be used. For example, a three contact blade configuration has outer contact blades that are power blades, hot and neutral contact blades, and a middle contact blade that is a ground contact blade.

The electrical connector 1 has three building wires 7 connected thereto, as shown in FIGS. 1-3. Although the electrical connector 1 of the first exemplary embodiment of the present invention is shown having three building wires 7 connected thereto, any suitable number of building wires may be used as required by the electrical apparatus for use with the electrical device 4. The building wires 7 are connected to the electrical connector 1 as described below. A plurality of feed-through wires 11 can be connected to the electrical connector 1, as shown in FIGS. 1-3, to supply power to another electrical device, such as an another electrical connector.

Figure 6:
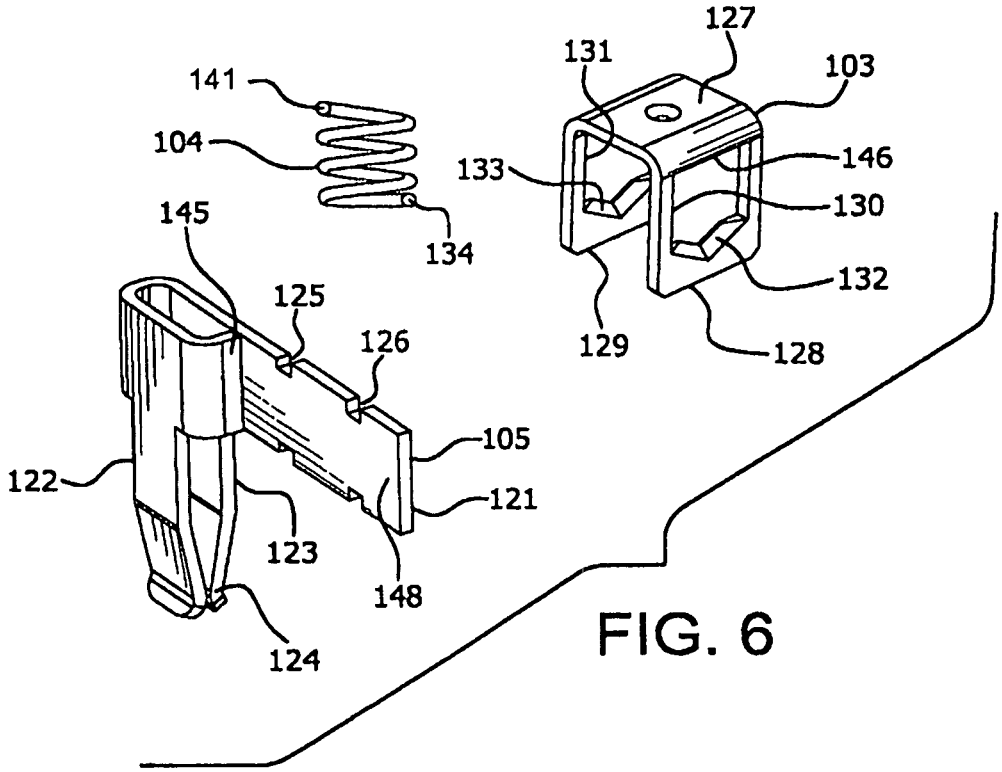
FIG. 6 is an exploded perspective view of the spring assembly of FIG. 4.

The electrical connector 1 is received by the aperture 2 in the base 53 of the electrical device 4, as shown in FIGS. 2 and 3. A plurality of openings are disposed in a front face of the electrical connector 1 to receive the contact blades 6. The electrical connector 1 has a base 68 and a cover 69 connected thereto. A fastener 70 connects the cover 69 to the base 68. A plurality of openings 9 and 10 are formed in the base 68 of the electrical connector 1 to receive the wires 7 and 11, respectively. The openings 9 and 10 are preferably disposed on the same side of the base 68, as shown in FIGS. 4 and 6.

Latching arms 71 are disposed on opposite sides of the base 68 of the electrical connector 1, as shown in FIGS. 1-3. The latching arms 71 are flexible to facilitate connecting the electrical connector to and disengaging from the electrical device 4. The latching arms 71 are deflectable to disengage the electrical connector 1 from a mated connection with the electrical device 4. The electrical connector 1 is connected to the electrical device 4 without requiring the use of tools. Accordingly, the exemplary embodiments of the present invention provide electrical continuity between existing building wires 7 and the electrical wire device 4 without requiring the use of tools.

A push-in wire connector 101 in accordance with a second exemplary embodiment of the present invention is shown in FIGS. 4-24. Each of the wires 107 is terminated by the push-in wire connector 101 through a push-in connection and a release member 102 connected to the push-in wire connector 101 provides a release mechanism to release the inserted wires 107. The release member 102 prevents accidental release of the inserted wires 107.

Figure 11:
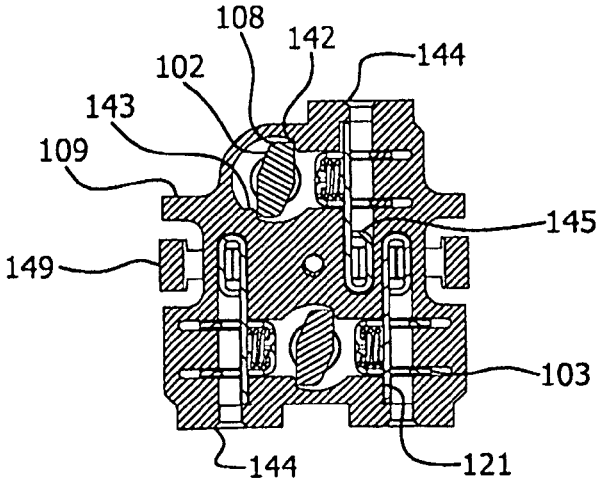
FIG. 11 is a front elevational view in cross section taken along line 11-11 of FIG. 10.
Figure 12:
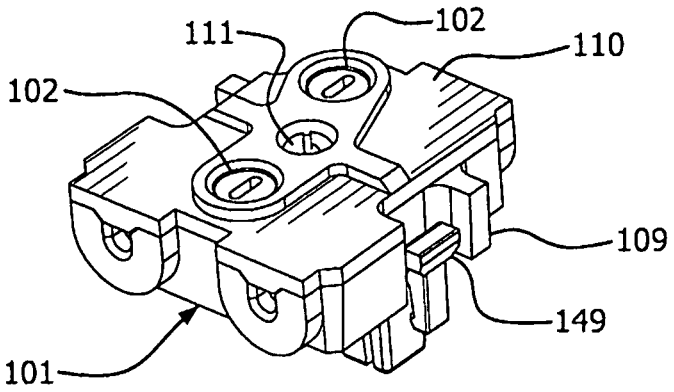
FIG. 12 is a rear perspective view of the push wire connector of FIG. 4.
Figure 13:
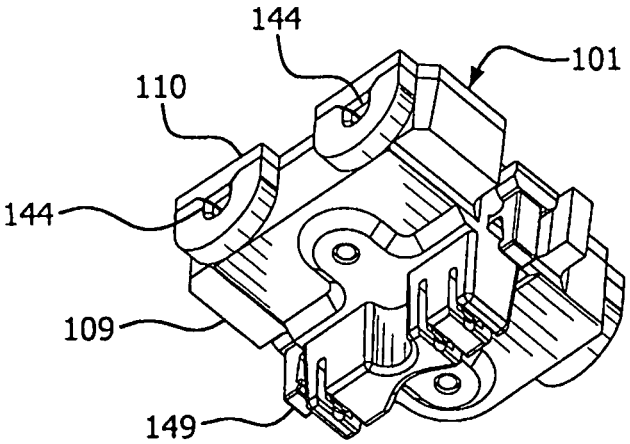
FIG. 13 is a top perspective view of the push wire connector of FIG. 4.
Figure 14:
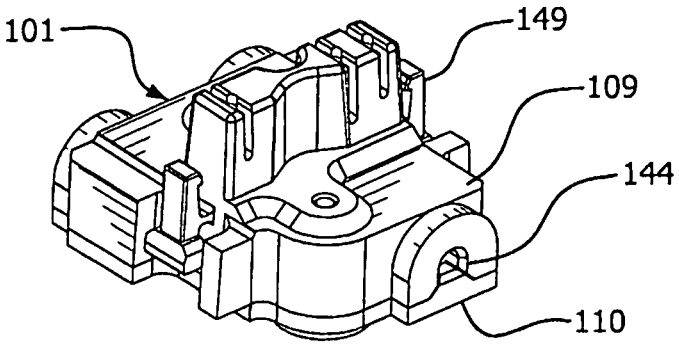
FIG. 14 is a bottom perspective view of the push wire connector of FIG. 4.
Figure 15:
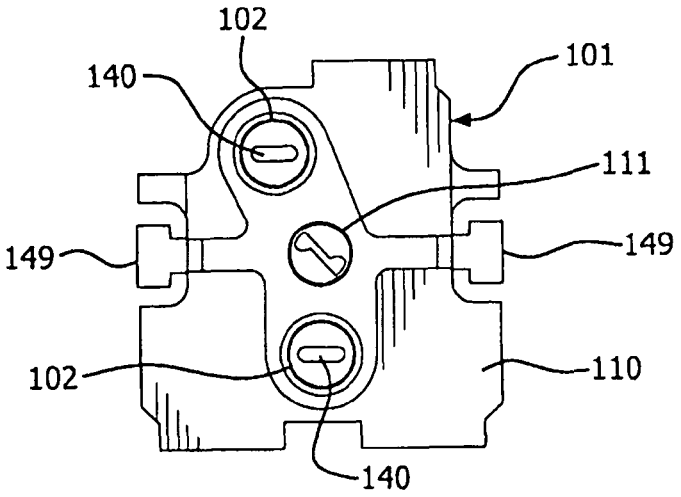
FIG. 15 is a rear elevational view of the push wire connector of FIG. 4 with pins in an unlocked position.
Figure 16:
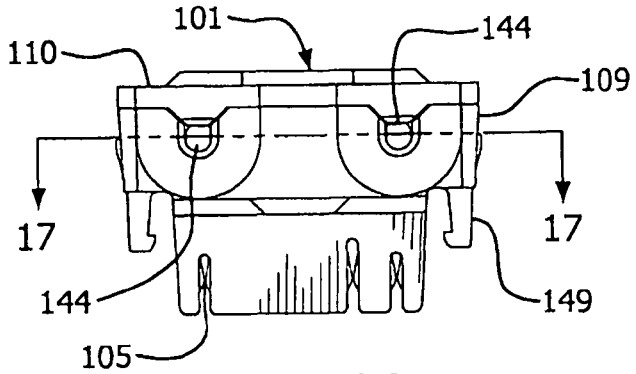
FIG. 16 is a top plan view of the push wire connector of FIG. 15.
Figure 17:
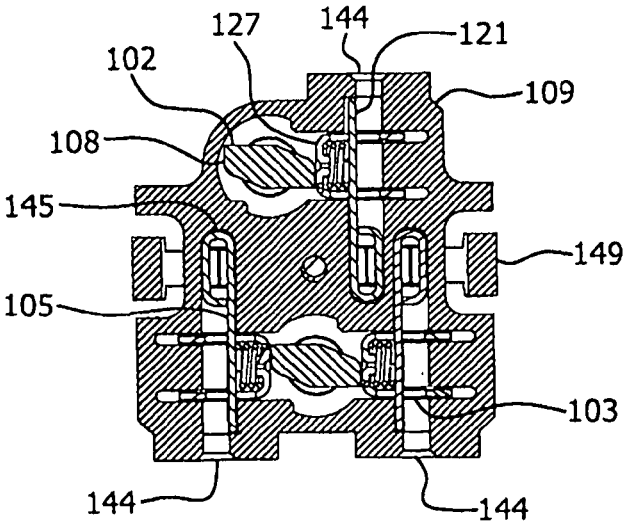
FIG. 17 is a rear elevational view in cross section of the push wire connector taken along line 17-17 of FIG. 16.
Figure 19:
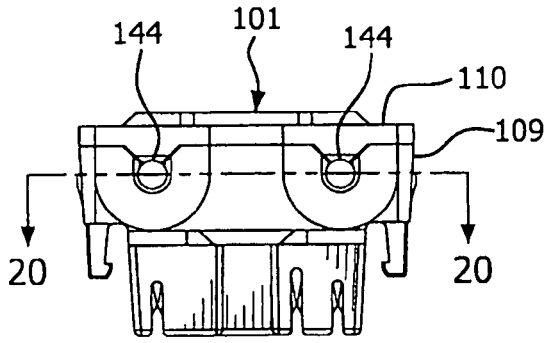
FIG. 19 is a top plan view of the push wire connector of FIG. 18.
Figure 18:
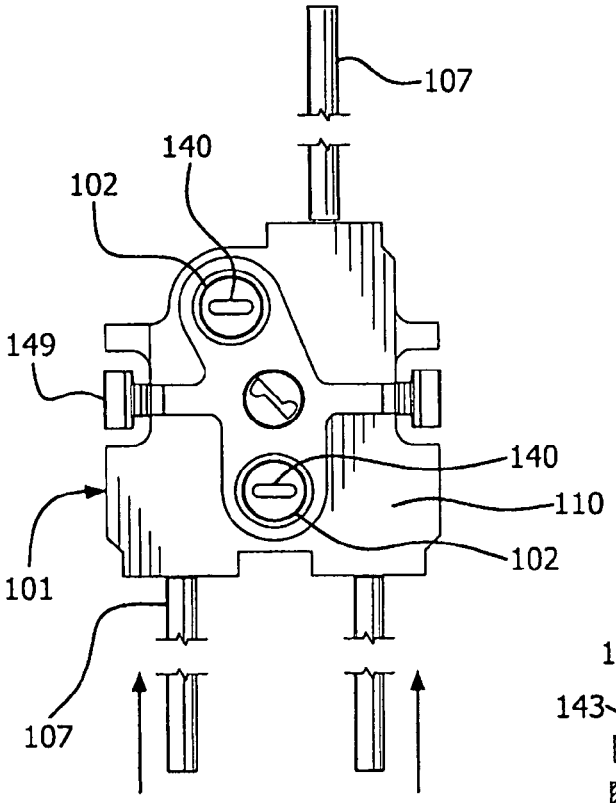
FIG. 18 is a rear elevational view of the push wire connector of FIG. 4 with pin in an unlocked position and receiving wires.

The electrical connector 101 has multiple wire locking and releasing mechanisms, as shown in FIGS. 4, 5, 11 and 17. Each wire locking and releasing mechanism includes locking member 103, a biasing member 104 and a rotatable member 102. The electrical connector 101 can be used for fast, reliable wire connections and releases. The electrical plug connector 101 can provide wire locking terminations for various plug connect 15A/20A wiring devices. The locking and releasing mechanism and the contact assemblies 105 are disposed in a housing base 109 and secured therein by a cover 110. The cover 110 is secured to the base 109 with a fastener 111, although any suitable means of connection can be used. As shown in FIGS. 11 and 17, one release member 102 operates two locking and releasing mechanisms.

Figure 7:
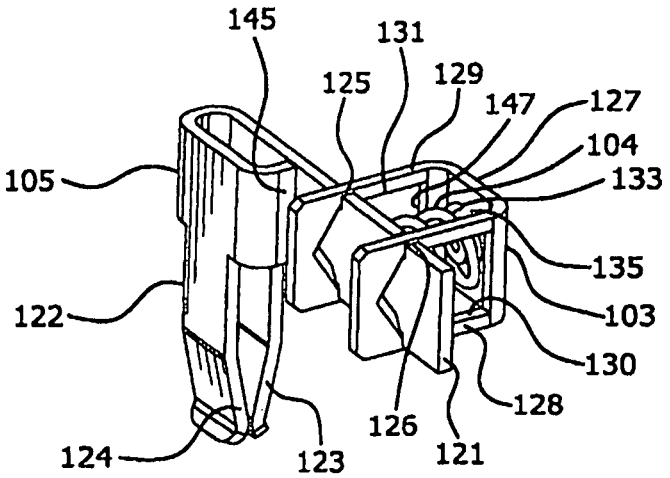
FIG. 7 is a perspective view of the spring assembly of the push wire connector of FIG. 6.
Figure 8:
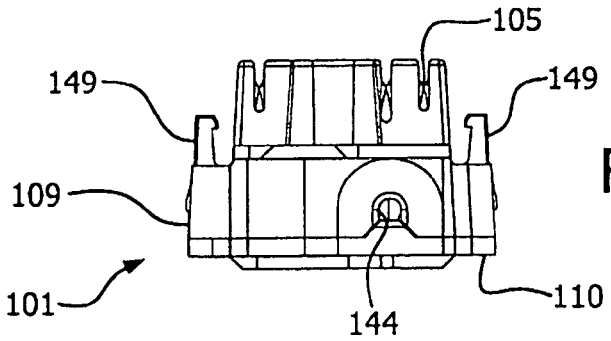
FIG. 8 is a bottom plan view of the push wire connector of FIG. 4.
Figure 9:
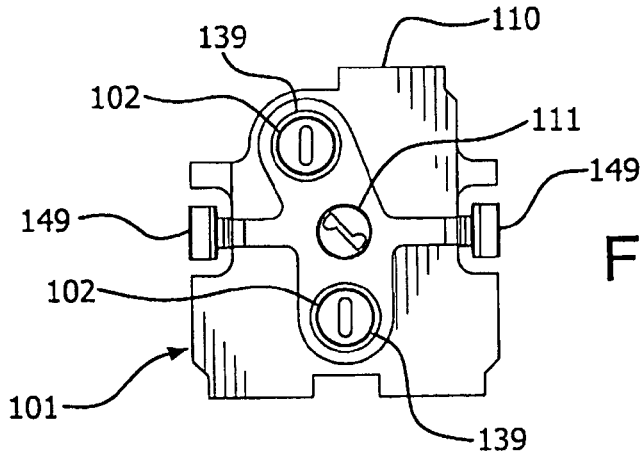
FIG. 9 is a rear elevational view of the push wire connector of FIG. 4.
Figure 10:
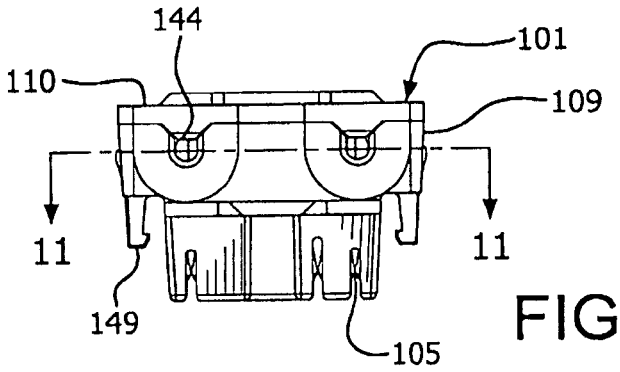
FIG. 10 is a top plan view of the push wire connector of FIG. 4.

The contact assembly 105, as shown in FIGS. 6 and 7, includes a substantially planar, wire contact member 121 and first and second flexible fingers 122 and 123 connected thereto. The first and second flexible fingers 122 and 123 engage one of the contact blades 6 of the electrical device 4 (FIG. 1). The flexible fingers 122 and 123 of the contact assembly 105 are biased to contact each other to form a gripping potion 124 therebetween to receive a contact blade 6. A gap is formed between outwardly extending portions at the free ends of the flexible fingers 122 and 123 of the contact assembly 105 to facilitate receiving the contact blade 6 therebetween. First and second pairs of notches 125 and 126 are disposed on opposite edges of the wire contact member 121 to receive the locking member 103.

The locking member 103 is preferably a substantially U-shaped, as shown in FIGS. 6 and 7. The locking member 103 has a base 127 from which first and second legs 128 and 129 extend. Preferably, the first and second legs 128 and 129 extend substantially perpendicularly from the base 127. First and second openings 130 and 131 are disposed in the first and second legs 128 and 129, respectively. Coined edges 132 and 133 are disposed at ends of the first and second openings 130 and 131 opposite the base 127 to facilitate retaining a wire received through the first and second openings.

The biasing member 104 has a first end 141 and a second end 134, as shown in FIGS. 6 and 7. The biasing member 104 is preferably a compression spring, although any suitable biasing member can be used. The first end 141 of the biasing member 104 engages an inner surface 135 of the base 127. A second end 134 of the biasing member 104 engages an outer surface 136 of the wire contact member 121, as shown in FIGS. 4 and 6.

Figure 23:
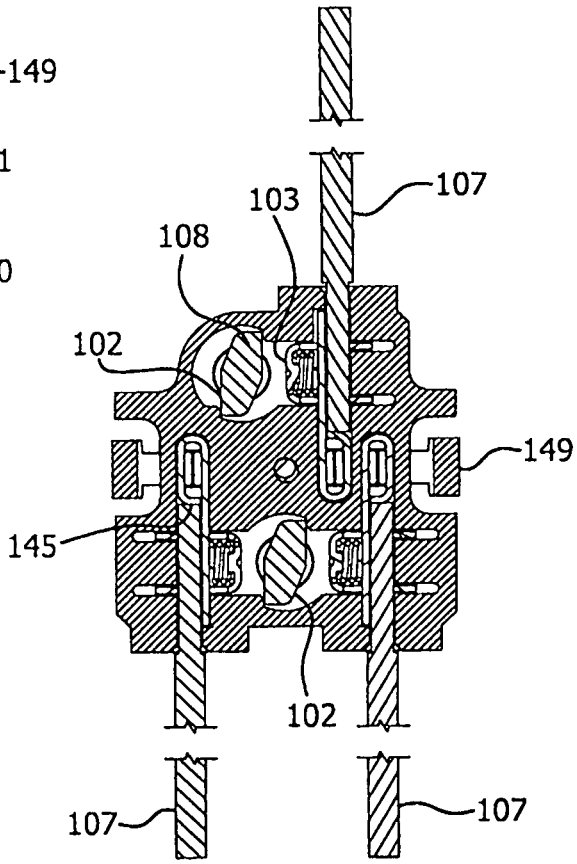
FIG. 23 is a rear elevational view in cross section of the push wire connector take along line 23-23 of FIG. 22.
Figure 24:
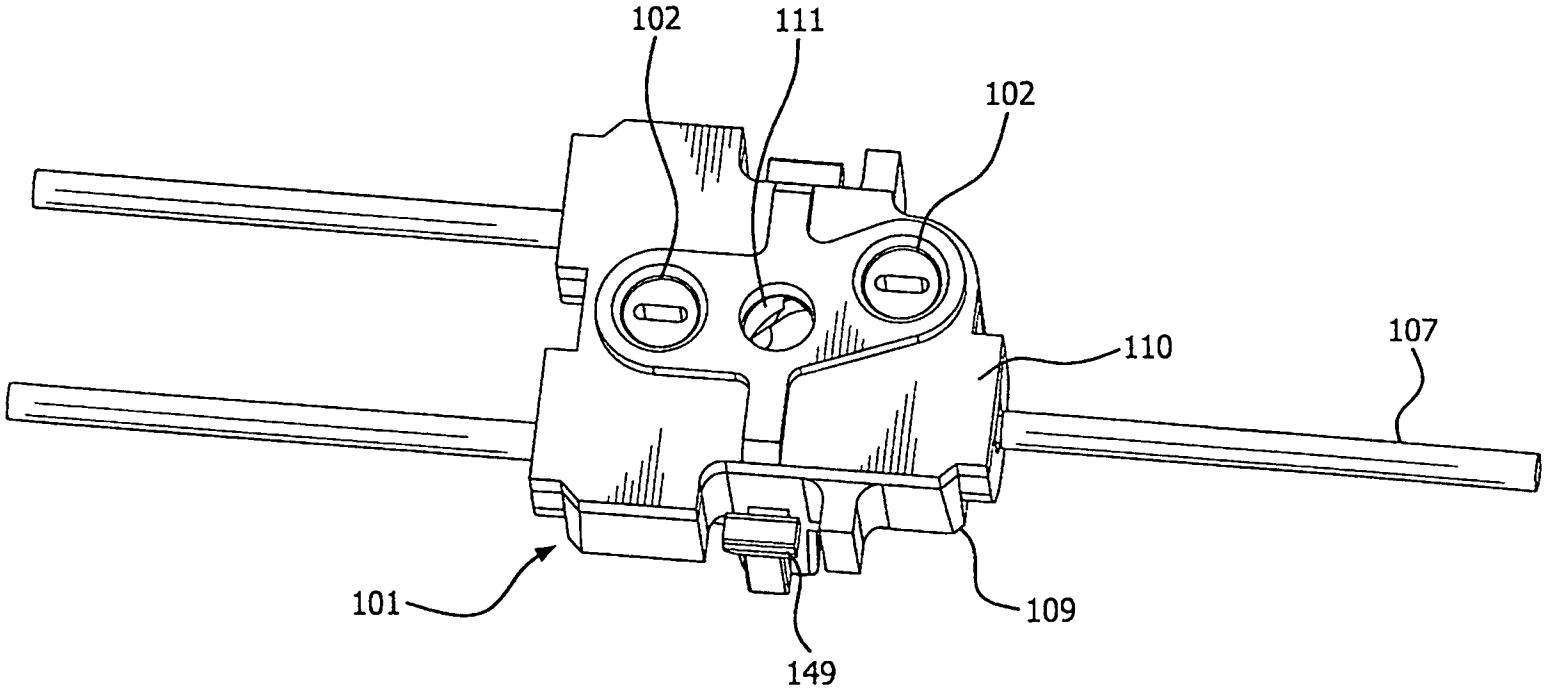
FIG. 24 is a perspective view of the push wire connector of FIG. 21.

The rotatable, release member 102 is received in a cavity 137 in the housing base 109, as shown in FIGS. 4 and 11. The cavity 137 allows for rotation of the rotatable member 102. A first end 138 of the rotatable member is accessible through an opening 139 in the cover 110. A slot 140 is disposed in the first end 138 of the rotatable member 102 to rotate the rotatable member between first and second positions. A cam surface 108 extends outwardly from the rotatable member, as shown in FIG. 4. First and second stop members 142 and 143 are oppositely disposed in the cavity 137 to engage the cam surfaces 108 to position the rotatable member 102 in the second position, as shown in FIGS. 11 and 23.

Figure 5:
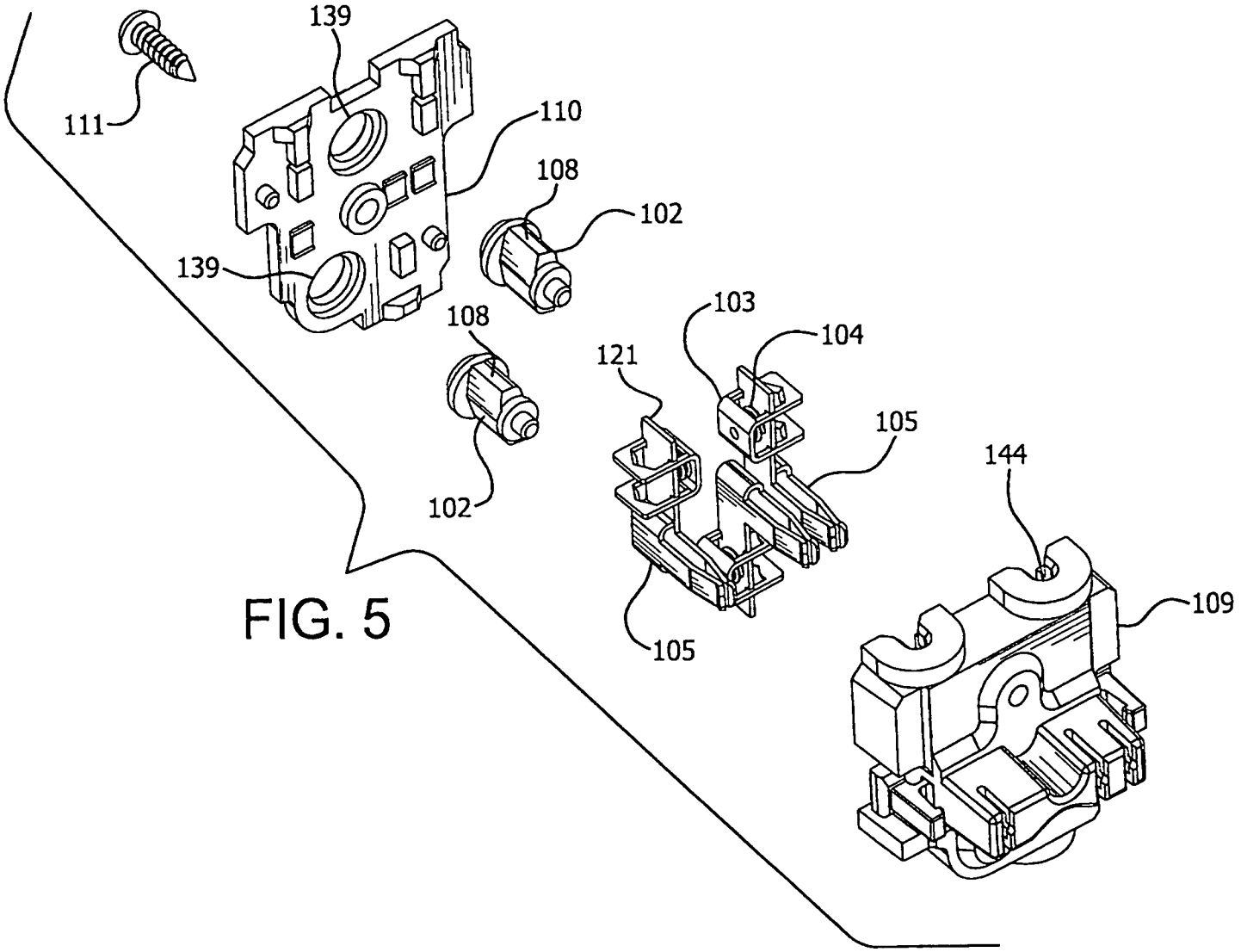
FIG. 5 is a rear exploded perspective view of the push wire connector of FIG. 4.

As shown in FIGS. 4 and 5, three contact assemblies 105 are disposed in the base 109. Two rotatable members 102 are disposed in the base 109. One of the rotatable members (the lower rotatable member as shown in FIG. 4) is disposed between two of the contact assemblies 105, such that the rotatable member controls operation of both contact assemblies 105. The cover 110 is secured to the base 109 with the fastener 111.

The biasing member 104 extends between the locking member 103 and the contact member 121 of the contact assembly 105, as shown in FIGS. 4 and 5. The contact member 121 extends through the first and second opening 130 and 131 in the first and second legs 128 and 129 of the locking member 103. The biasing member 104 biases the contact member 121 toward the coined edges 132 and 133 of the first and second openings 130 and 131.

Figure 20:
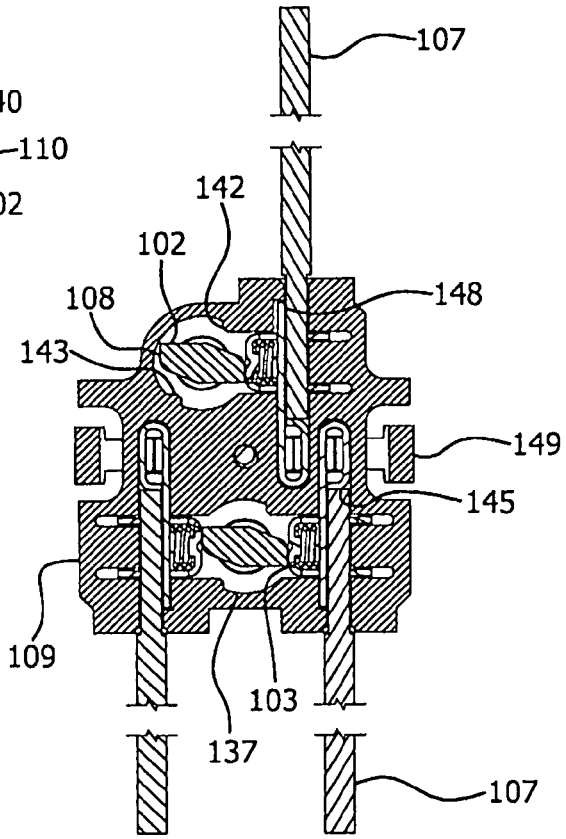
FIG. 20 is a rear elevational view in cross section of the push wire connector taken along line 20-20 of FIG. 19.
Figure 22:
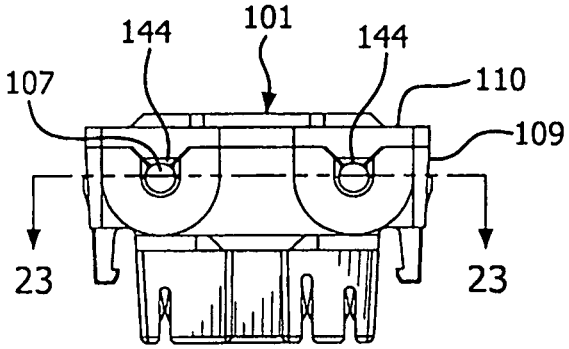
FIG. 22 is a top plan view of the push wire connector of FIG. 21.
Figure 21:
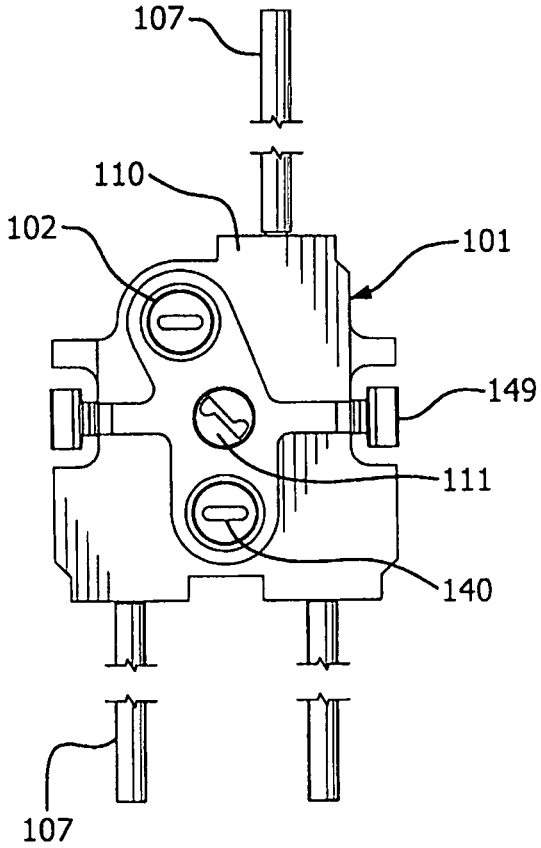
FIG. 21 is a rear elevational view of the push wire connector of FIG. 4 receiving wires and the pins in a locked position.

The rotatable member 102 is disposed adjacent the base 127 of the locking member 103, as shown in FIGS. 11, 17, 20 and 33. In the first and unlocked position, as shown in FIGS. 17 and 20, the cam surface 108 of the rotatable member 102 engages the base 127 of the locking member 103, thereby pushing the base 127 of the locking member 103 toward the contact member 121 of the contact assembly 105. The coined edges 132 and 133 of the locking member 103 are moved away from the contact member 121, thereby providing a passageway for insertion of a wire 107 through a wire opening 144 in the base 109 of the connector 101. The cam surface 108 contacting the base 127 of the locking member 103 overcomes the force of the biasing member 104, thereby compressing the biasing member 104 and moving the coined edges 132 and 133 away from the contact member 121.

As shown in FIG. 17, three wire openings 144 are disposed in the base 109 to provide access to the three contact assemblies 105. Exposed or bare portions of the wires 107 can now be inserted through the wire openings 144 and through the openings 130 and 131 in the first and second legs 128 and 129 of the locking member 103. Further insertion of the wire 107 is prevented by the free end of the wire 107 contacting a stopping member 145 of the contact assembly 105, as shown in FIGS. 6, 7, 20 and 23. Inner edges 146 and 147 (FIGS. 6 and 7) of the openings 130 and 131 abut the outer surface 136 (FIG. 4) of the contact member 121, thereby preventing further rotation of the rotatable member 102. As shown in FIG. 11, one wire opening 144 is disposed on a first side of the base 109 and two wire openings 144 are disposed on a second and opposite side of the base 109. The two wire openings 144 disposed on the same side of the base 109 allow for insertion of wires 107 in a direction substantially parallel to one another.

After the wires 107 are inserted, the rotatable member 102 is rotated such that the cam surfaces 108 no longer engage the base 127 of the locking member 103, as shown in FIGS. 11 and 23. The rotatable member 102 is rotated to the second and locked position in which the cam surfaces 108 contact the stopping members 142 and 143 of the base 109 to prevent further rotation of the rotatable member 102. The biasing member 104 returns to its original position, such that the base 127 of the locking member 103 moves away from the contact member 121 of the contact assembly 105. The coined edges 132 and 133 of the locking member 103 are moved toward the contact member 121, thereby locking the inserted wire 107 between the coined edges 132 and 133 of the locking member 103 and an inner surface 148 of the contact member 121. Rotating the rotatable member 102 back to the first position to engage the cam surface 108 with the base 127 of the locking member 103 compresses the biasing member 104 and moves the coined edges 132 and 133 away from the contact member 121, thereby allowing the inserted wire 107 to be removed. As shown in FIGS. 17 and 20, each of the cam surfaces 108 of the lower rotatable member 102 engages a different locking member 103 such that the rotatable member controls locking and releasing of two wires 107. The slot 140 in the rotatable member 102 facilitates rotating the rotatable member 102 between the first and second positions.

Latches 149 connected to the base 109 of the connector 101 facilitate connecting the connector to and removing the connector from the aperture 2 (FIG. 1) in the rear surface 3 of the electrical device 4. After the wires 107 have been inserted, the electrical connector 101 can be inserted in the aperture 2 in the rear surface 3 of the electrical device 4, as shown in FIGS. 1-3. The wires 107 can be quickly and easily inserted in the wire openings 144 in the electrical connector 101. The electrical connector 101 can be quickly and easily connected to the electrical device 4 without requiring the use of tools. Accordingly, electrical continuity can be established between the existing building wires and the electrical device quickly and easily.

A push-in wire connector 201 in accordance with a third exemplary embodiment of the present invention is shown in FIGS. 25-36. Each of the wires 207 is terminated by the push-in wire connector 201 through a push-in connection and a release member 202 connected to the push-in wire connector 201 provides a release mechanism to release the inserted wires 207. The release member 202 prevents accidental release of the inserted wires 207.

Figure 25:
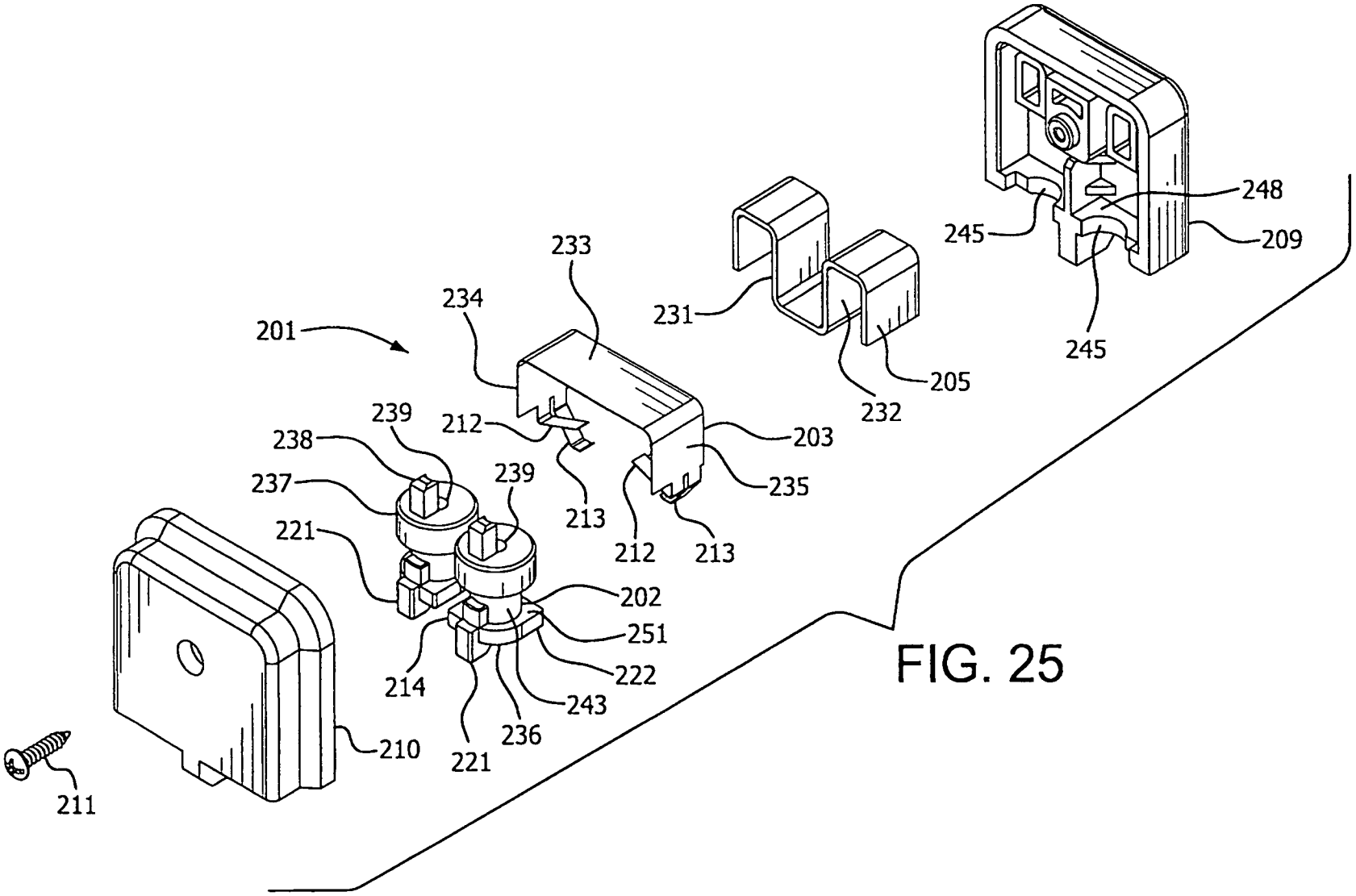
FIG. 25 is a front exploded perspective view of a push wire connector in accordance with a third exemplary embodiment of the present invention.

The electrical connector 201 has multiple wire locking and releasing mechanisms, as shown in FIG. 25. The wire locking and releasing mechanism includes a contact assembly 205, a biasing member 203 and a release member 202. The electrical connector 201 can be used for fast, reliable wire connections and releases. The electrical connector 201 provides wire locking terminations for quickly and easily connecting electrical wires 207. The locking and releasing mechanisms are disposed in a housing base 209 and secured therein by a cover 210. The cover 210 is secured to the base 209 with a fastener 211, although any suitable means of connection can be used.

Figure 27:
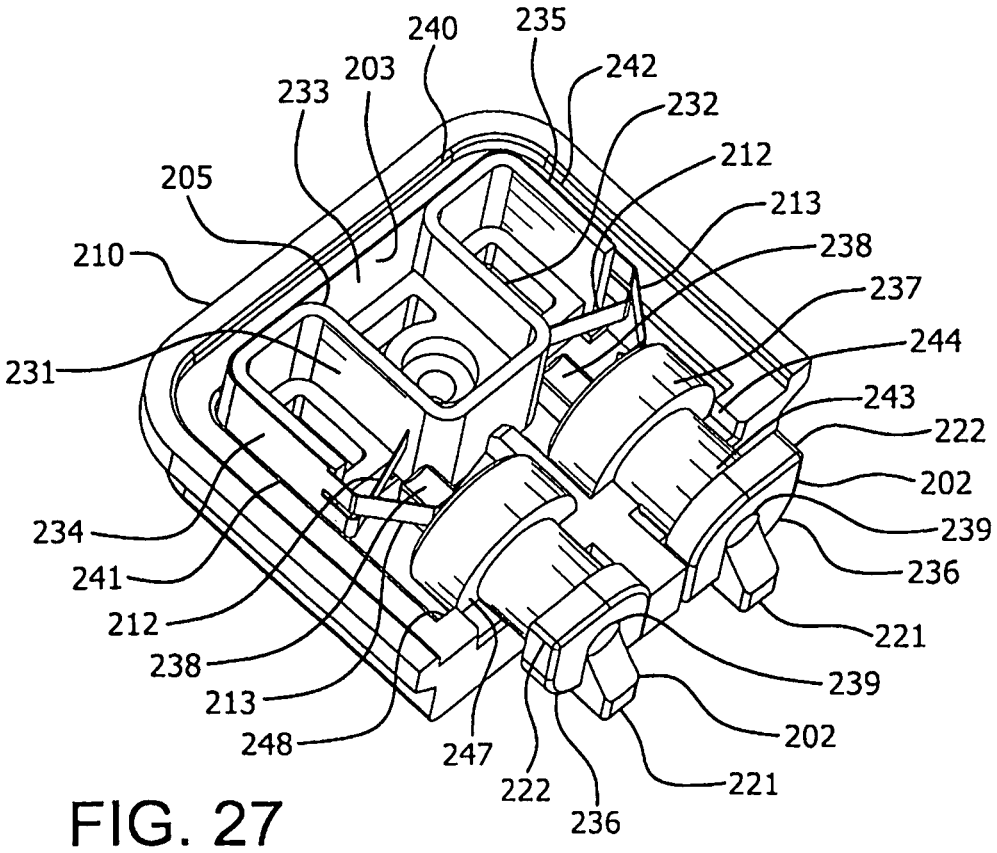
FIG. 27 is a perspective view of the push wire connector of FIG. 25 with the rear housing removed.

The contact assembly 205, as shown in FIGS. 25 and 27, includes first and second substantially planar, wire contact members 231 and 232 for electrically engaging inserted wires 207. The first and second contact members 231 and 232 are preferably substantially parallel. Preferably, the contact assembly is made of a conductive material. The contact assembly 205 is preferably unitarily formed as a single piece.

The biasing member 203 has a substantially planar base 233 from which first and second legs 234 and 235 extend outwardly, as shown in FIG. 25. Preferably, the first and second legs 234 and 235 are substantially perpendicular to the base 233. First and second flexible arms 212 and 213 extend from free ends of each of the first and second legs 234 and 235. The first arm 212 preferably extends toward the base 233. The second arm 213 preferably extends away from the base 233. The biasing member is preferably unitarily formed as a single piece.

Figure 26:
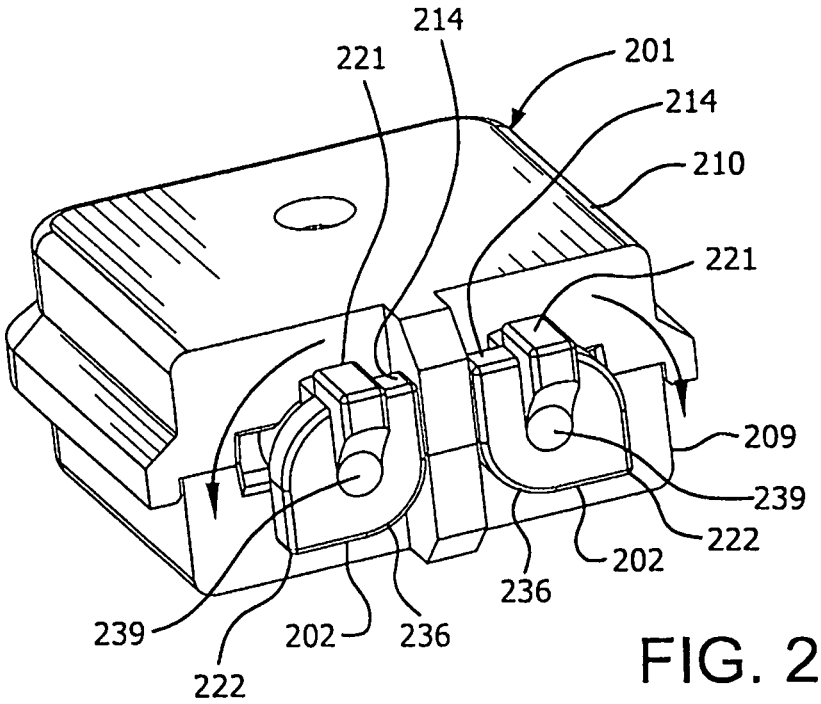
FIG. 26 is a front perspective view of the push wire connector of FIG. 25.
Figure 32:
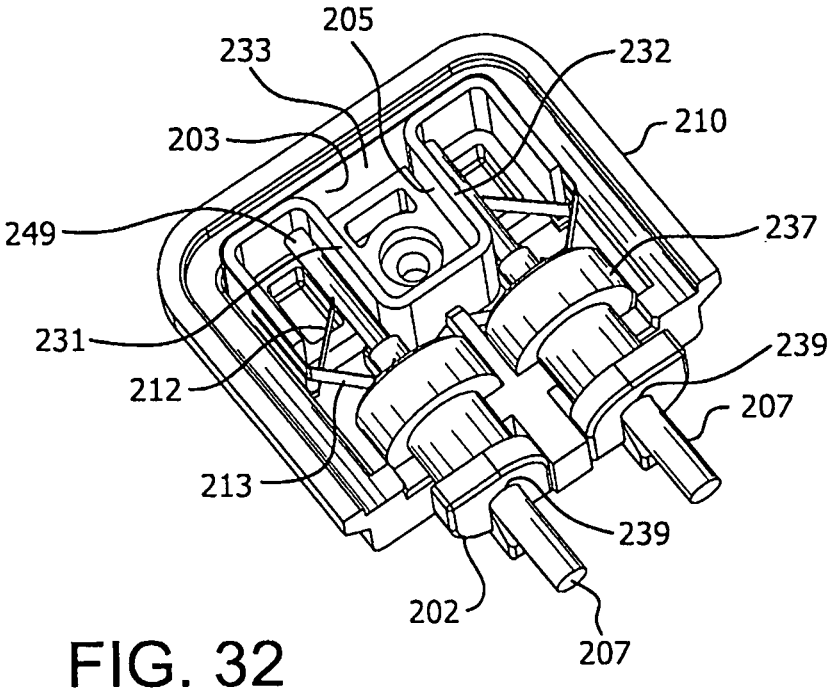
FIG. 32 is a perspective view of the push wire connector of FIG. 30 receiving wires without a cover in an unlocked position.
Figure 33:
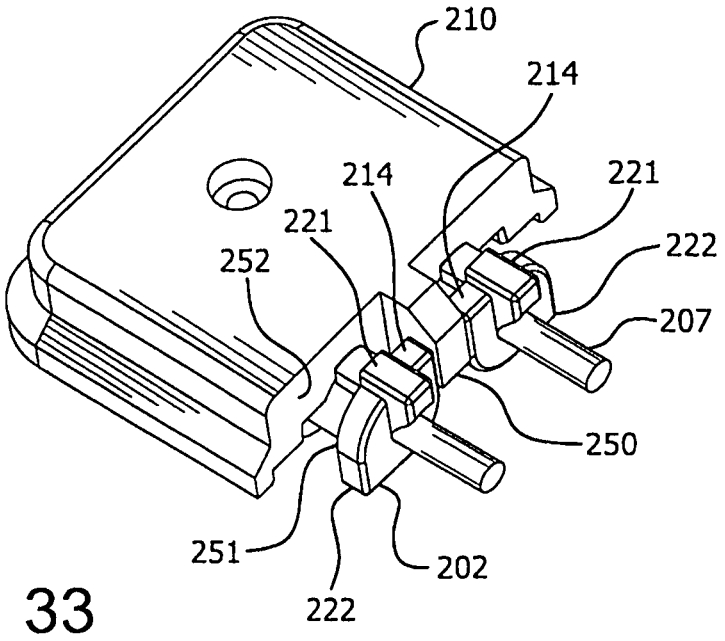
FIG. 33 is a perspective view of the push wire connector of FIG. 31 receiving wires with the locking tabs in an unlocked position without a cover.

The release member 202 has a first base member 236 disposed externally of the base 209 and cover 210 of the housing, as shown in FIGS. 26 and 27. A second base member 237 of the release member 202 is disposed internally of the base 209 and cover 210, as shown in FIG. 27. A shaft 243 extends between the first and second bases 236 and 237. A post 238 extends outwardly from the second base member 237. Preferably, the post 238 extends substantially perpendicularly to the second base member 237. A through hole 239 passes entirely through the release member, as shown in FIG. 32. The post 238 preferably extends in a directly substantially parallel to a longitudinal axis of the though hole 239.

A tab 221 extends radially outwardly from the through hole 239 in the first base member 236 of the release member 202, as shown in FIGS. 25 and 26. Oppositely disposed first and second cam surfaces 214 and 222 are formed on the first base member 236, as shown in FIGS. 25-27.

Figure 28:
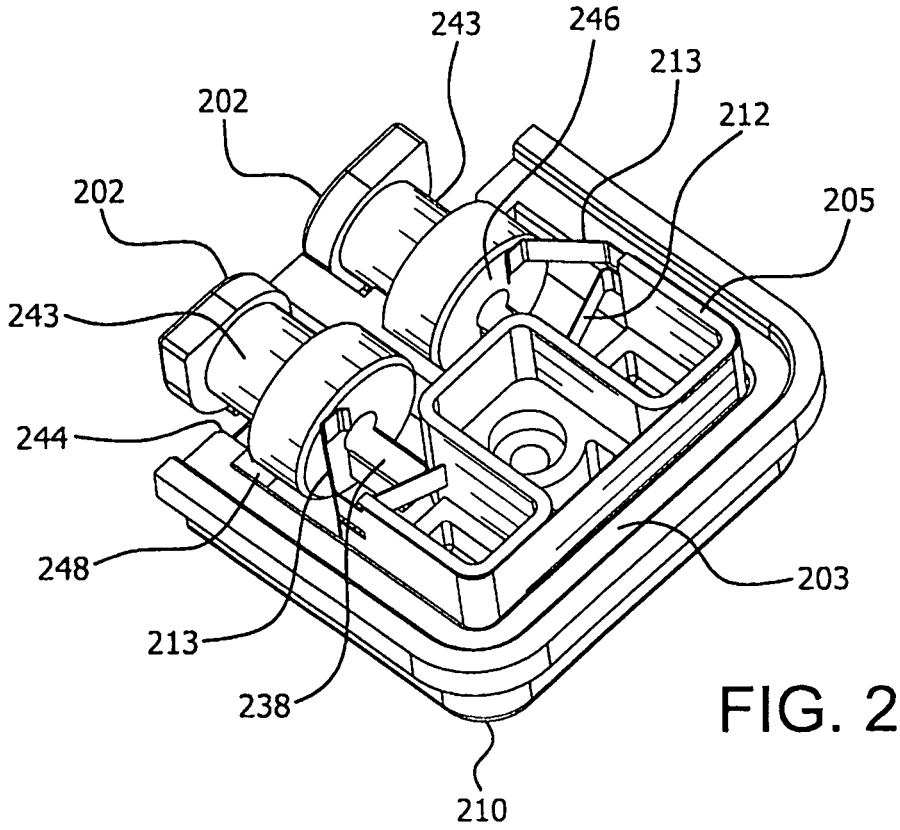
FIG. 28 is a perspective view of the push wire connector of FIG. 25 with the front housing removed.
Figure 29:
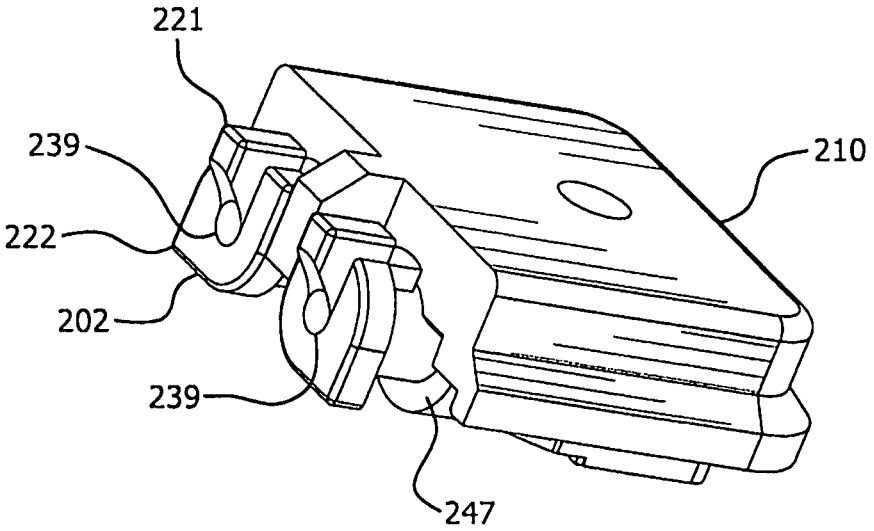
FIG. 29 is a perspective view of the push wire connector of FIG. 25.
Figure 30:
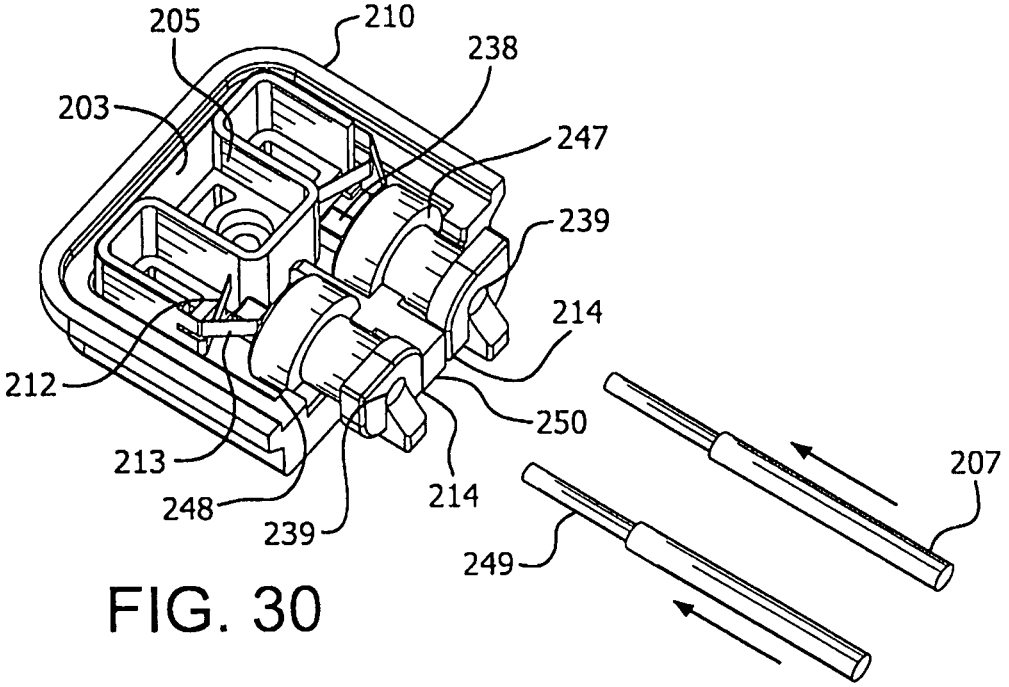
FIG. 30 is a perspective view of the push wire connector of FIG. 27 prior to receiving wires without a cover.
Figure 31:
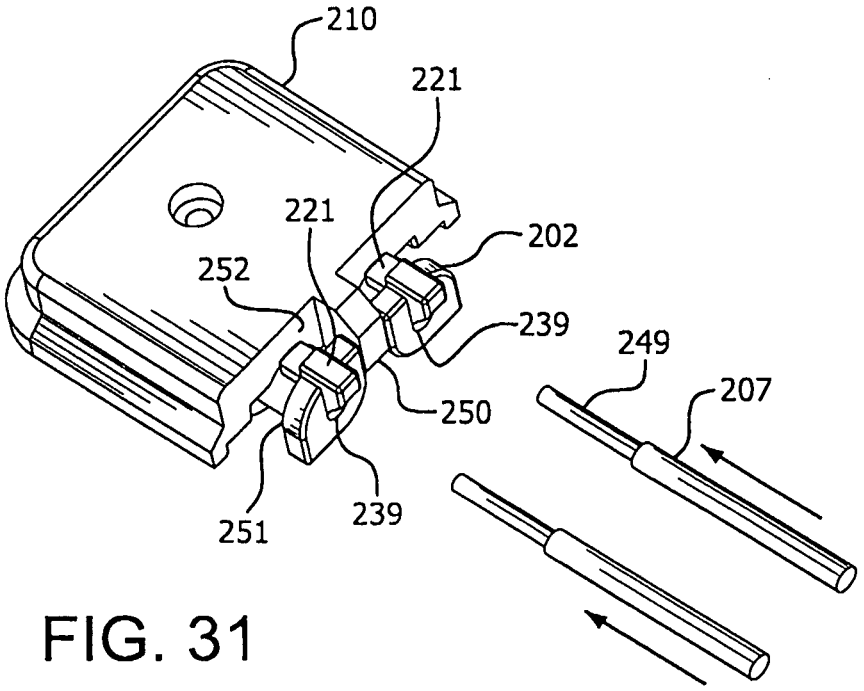
FIG. 31 is a perspective view of the push wire connector of FIG. 29 prior to receiving wires without a cover.

The biasing member 203 and the contact assembly 205 are disposed in the cover 210, as shown in FIG. 27. The base 233 of the biasing member 203 is adjacent an inner lower wall 240 of the cover 210. The first and second legs 234 and 235 of the biasing member 203 are adjacent inner side walls 241 and 242 of the cover 210. The contact assembly 205 is disposed in the cover 210 such that the biasing member 203 is disposed between the contact assembly 205 and the inner walls 240, 241 and 242 of the cover 210. The first arms 212 of the biasing member 203 extend toward the contact members 231 and 232 of the contact assembly. The shafts 243 of the release members 202 are disposed in recesses 244 in the cover 210, as shown in FIGS. 27 and 28, and the base 209 is connected thereto, such as with a fastener 211 (FIG. 25). Corresponding recesses 245 are formed in the base to form an opening in which the shaft 243 of the release member 202 is rotationally and axially movable. The second arms 213 of the biasing member 203 contact a lower surface 246 of the second base member 237, as shown in FIG. 28, to bias the release member 202 to a first position. The second arm 213 biases the release member upwardly such that an upper surface 247 of the second base member 237 contacts an inner upper wall 248 of the base 209 and cover 210 of the housing, as shown in FIGS. 25-29.

Wires 207 are insertable through the through holes 239 in the release members 202, as shown in FIGS. 30-33. Exposed or bare portions 249 of the wires 207 deflect the free ends of the first arms 212 of the biasing member 203 and are secured against the contact members 231 and 232 of the contact assembly 205. The posts 238 guide insertion of the wires 207. The first arms 212 bias the inserted wires 207 against the contact members 231 and 232. The first arms 212 being angled toward the base 233 of the contact assembly 205 causes the first arms 212 to substantially prevent axial movement of the inserted wire in a direction away from the base 233. Accordingly, the first arms 212 substantially prevent removal of the inserted wires 207. As shown in FIGS. 30-33, the release members 202 are in a first and locked position. The first cam surface 208 of the release member 202 engages a stop member 250 of the housing to prevent rotation in one direction. In the first position, an inner surface 251 of the first base member 236 of the release member 202 is spaced from an outer surface 252 of the housing. The tab 221 engages the outer surface 252 such that inward axial movement of the release member 202 is prevented. The upper surface 247 of the second base member 202 engages the inner upper wall 248 of the housing to prevent outward axial movement of the release member 202. Electrical continuity is established from on inserted wire 207, through the contact assembly 205 and to the other inserted wire 207.

Figure 34:
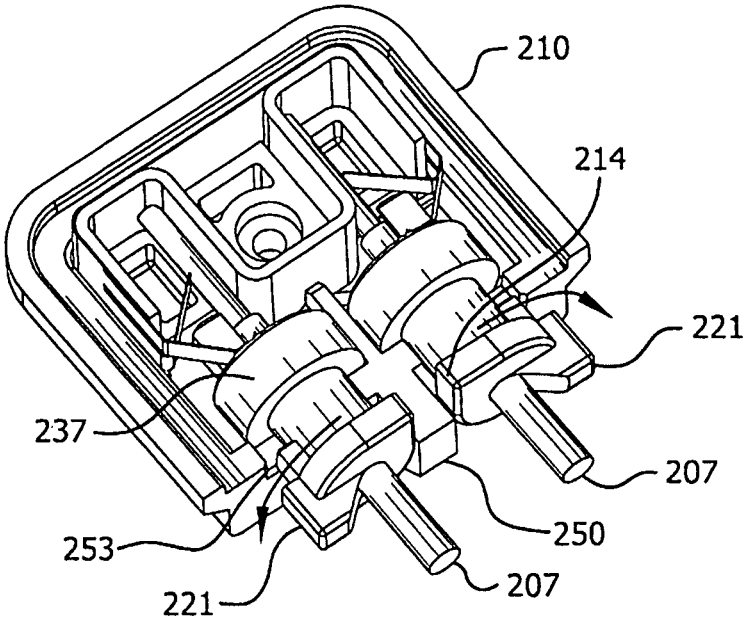
FIG. 34 is a perspective view of the push wire connector of FIG. 33 with the locking tabs moved to a locked position without a cover.
Figure 35:
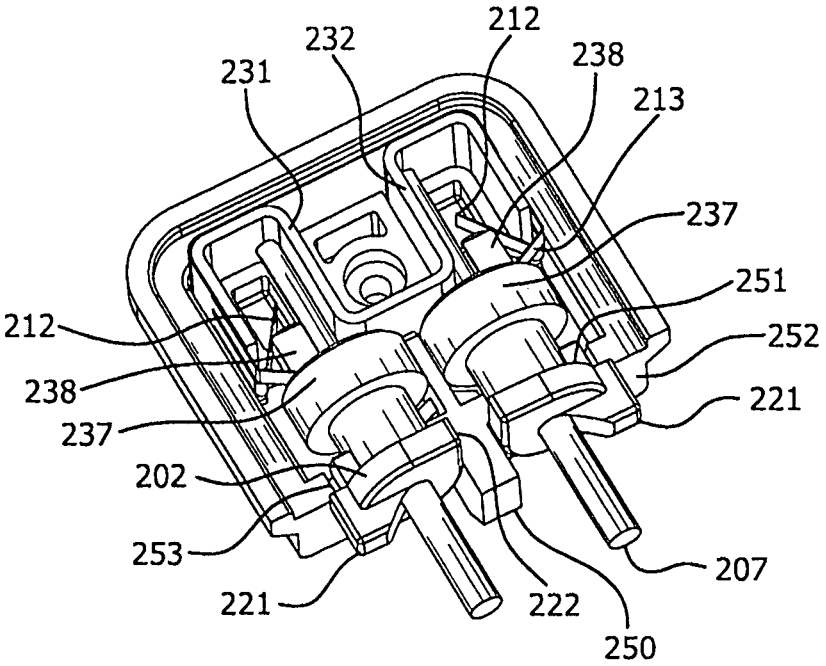
FIG. 35 is a perspective view of the push wire connector of FIG. 34 with the locking tab moved to a releasing position without a cover.
Figure 36:
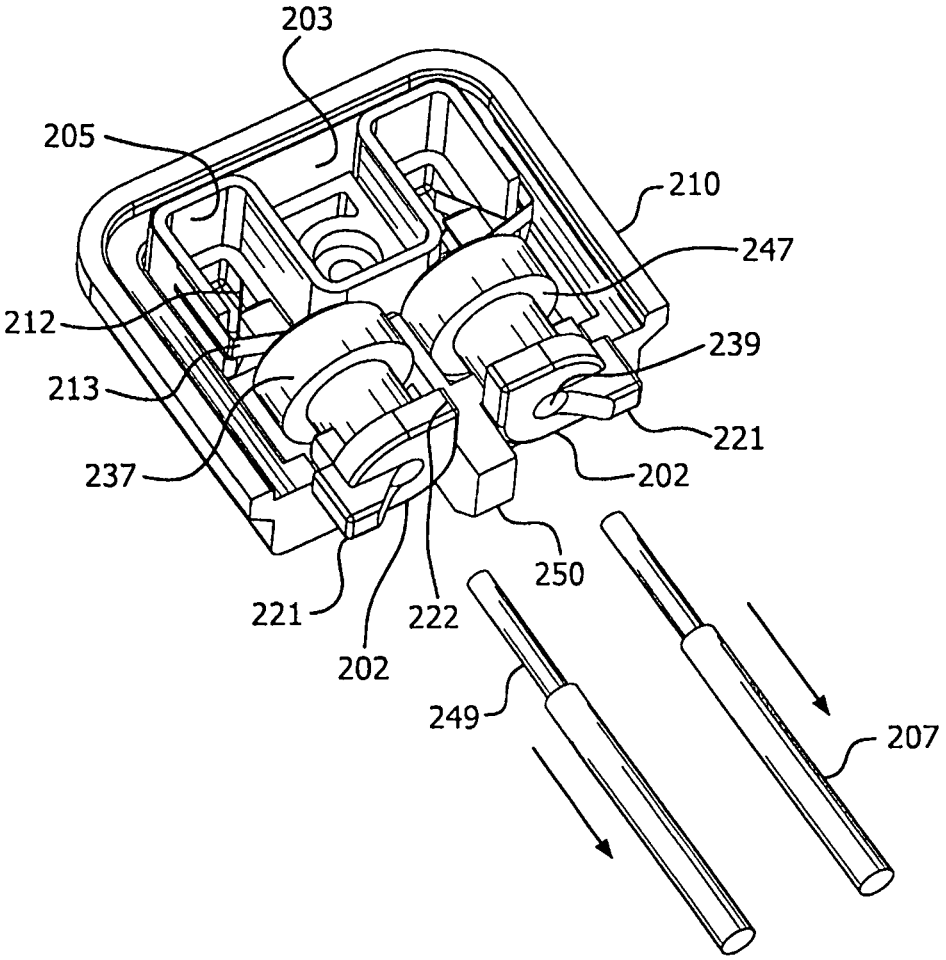
FIG. 36 is a perspective view of the push wire connector of FIG. 35 in which the wires are released without a cover.

To release the inserted wires 207, the release member 202 is rotated approximately 90 degrees from the first position to the second position, as shown in FIGS. 34-36. The release members 202 can only be rotated in one direction as the stop member 250 engages the first cam surfaces 214 to prevent rotation in the other direction. After the release members 202 have been rotated to the second position, as shown in FIG. 35, the release members 202 are pushed axially inwardly such that the inner surface 251 of the first base member 236 contacts the outer surface 252 of the housing. In the second position, the tabs 221 of the release members 202 are aligned with grooves 253 in the recesses 245 to allow inward axial movement of the release member 202. Prior to being in the second position, the tabs 221 engage the outer surface 252 of the housing to prevent inward axial movement. The second cam surface 222 engages the stop member 250 to prevent further rotation of the release member, in additional to aligning the tabs 221 with the grooves 253. From the second position, the release members 202 can only be rotated in a direction back to the first position due to the second cam surfaces 222 engaging the stop member 250.

The release members 202 can now be pushed axially inwardly into the body of the electrical connector 201 to a third position to deflect the first and second arms 212 and 213 to allow for removal of the inserted wires 207. The inward axial movement of the posts 238 of the release members 202 engages the first arms 212, thereby deflecting the first arms 212 away from the inserted wires 207 and away from the contact members 231 and 232, as shown in FIG. 35. The inserted wires 207 can now be easily withdrawn from the electrical connector 201, as shown in FIG. 26. The lower surface 246 of the second base member 237 deflects the second arm 213 when the release member 202 is pushed axially inwardly. In the third position, the grooves 253 prevent rotation in either direction of the release member 202.

The second arm 213 moves the release member 202 axially outwardly when the inward axial force on the release member 202 is stopped. The deflected second arm 213 moves back to its original position, thereby engaging the lower surface 246 of the second base member to push the release member 202 axially outwardly. The release member 202 moves axially outwardly until the upper surface 247 of the second base member 237 abuts the inner upper wall 248 of the housing. The tab 221 is now free of the recess 253 such that the release member 202 can be rotated back to the first position (FIG. 30) such that wires 207 can be inserted.

As shown in FIGS. 26 and 34, the two release members 202 are rotated in opposite directions when rotating between first and second positions. Additionally, the two release members 202 move independently of one another. Although two release members 202 are shown for electrically connecting two wires 207, any suitable number of locking and releasing mechanisms can be used as required by the number of wires to be electrically connected.

The wires 207 can be quickly and easily inserted in the wire openings 239 in the electrical connector 201 without requiring the use of tools. Accordingly, electrical continuity can be established between two wires quickly and easily.

The foregoing embodiments and advantages are merely exemplary and are not to be construed as limiting the scope of the present invention. The description of an exemplary embodiment of the present invention is intended to be illustrative, and not to limit the scope of the present invention. Various modifications, alternatives and variations will be apparent to those of ordinary skill in the art, and are intended to fall within the scope of the invention as defined in the appended claims and their equivalents.

What is claimed is:

1. An electrical connector, comprising:

a housing;

a conductive contact assembly disposed in said housing and having a contact portion for electrically engaging an inserted electrical wire;

a biasing member disposed in said housing and biasing a locking member towards an unlocked position; and a release member having a cam surface, the release member movable between locked and release positions, said release member being in said locked position when said cam surface engages said locking member which allows for insertion of the electrical wire such that the inserted wire is secured between said first resilient arm and said contact portion and prevented from being withdrawn therefrom, and said release member being in said release position when said cam surface disengages said biasing member which deflects said first resilient arm such that the inserted wire is withdrawable; and wherein said release member is rotated from said locked position to an intermediate position, and moved axially from said intermediate position to said release position.

2. The electrical connector according to claim 1, wherein the wire is inserted through a through hole in said release member.

3. The electrical connector according to claim 1, wherein said release member is manually movable externally of said housing.

4. The electrical connector according to claim 1, wherein a stop member on said housing limits rotation of said release member.

5. The electrical connector according to claim 1, wherein said biasing member has a second resilient arm to bias said release member from said release position to said intermediate position.

* * * * *